US006178688B1

(12) United States Patent
Keating

(10) Patent No.: US 6,178,688 B1
(45) Date of Patent: Jan. 30, 2001

(54) CONTAINER SYSTEMS FOR FLORAL ARRANGEMENTS

(75) Inventor: Kevin Keating, Canterbury (AU)

(73) Assignee: Betty McDowell (Aust.) Pty. Ltd., Coburg (AU)

( * ) Notice: Under 35 U.S.C. 154(b), the term of this patent shall be extended for 0 days.

(21) Appl. No.: 09/289,291

(22) Filed: Apr. 9, 1999

(30) Foreign Application Priority Data

Apr. 20, 1998 (AU) ..... 3080/98

(51) Int. Cl.[7] ..... A01G 5/00; A47G 7/00

(52) U.S. Cl. ..... 47/41.12; 47/41.01; 47/41.11; 47/79

(58) Field of Search ..... 47/79, 80, 41.01, 47/59, 41.12, 41.11

(56) References Cited

U.S. PATENT DOCUMENTS

| | | | | |
|---|---|---|---|---|
| 2,774,187 | * | 12/1956 | Smithers | 47/80 |
| 2,830,405 | * | 4/1958 | Nydegger | 47/79 |
| 3,552,059 | * | 1/1971 | Moore | 47/79 |
| 3,867,789 | | 2/1975 | Jacobson | 47/41.12 |
| 4,600,612 | * | 7/1986 | Litwin et al. | 47/80 |
| 4,936,046 | * | 6/1990 | Miller | 47/79 |
| 4,941,572 | | 7/1990 | Harris | 206/423 |
| 5,515,644 | | 5/1996 | Weder et al. | 47/41.12 |

FOREIGN PATENT DOCUMENTS

| | | |
|---|---|---|
| 8191629A | 7/1996 | (JP) . |
| 99004716/01 | 10/1998 | (JP) . |

* cited by examiner

*Primary Examiner*—Peter M. Poon
*Assistant Examiner*—Judith A. Nelson
(74) *Attorney, Agent, or Firm*—Harness, Dickey & Pierce, P.L.C.

(57) ABSTRACT

A container system for a floral arrangement, comprising a waterproof container having a base portion which can act as a water reservoir, and a separate insert locatable from above into a lower part of the container, the insert acting to confine from above water within the reservoir, the insert carrying a porous water-retaining material lying within the reservoir, the porous material extending upwardly through the insert so that an upper portion of the material is exposed to receive the stems of cut flowers and the like.

6 Claims, 3 Drawing Sheets

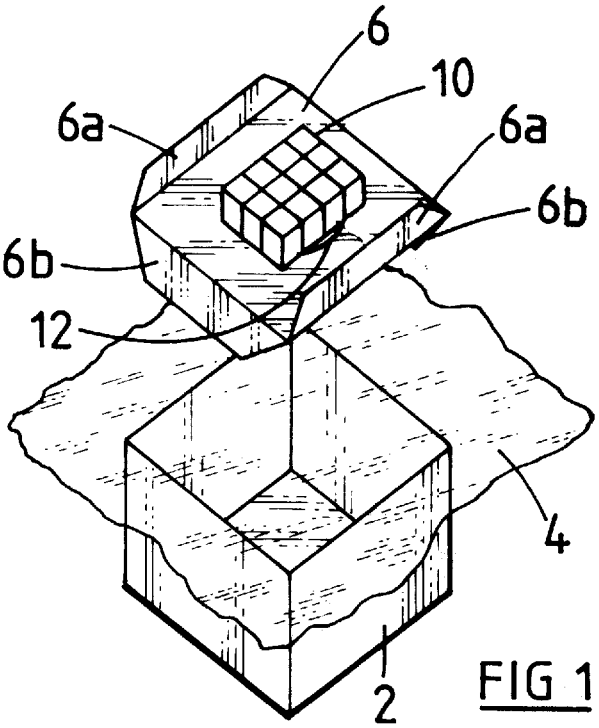
FIG 1
FIG 2
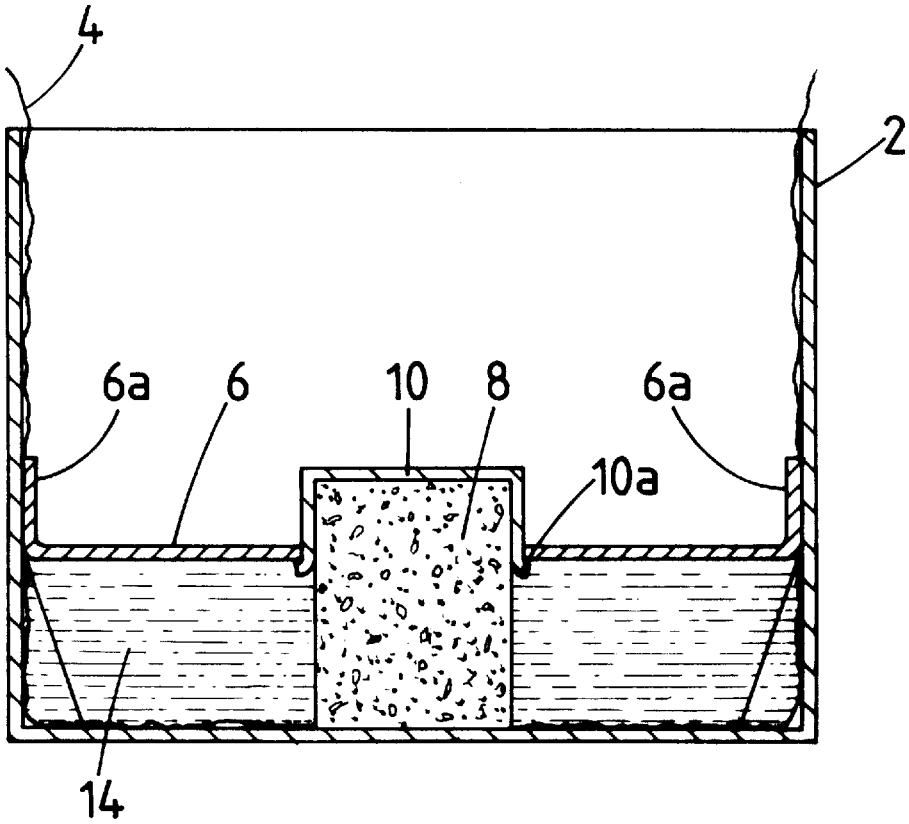

CONTAINER SYSTEMS FOR FLORAL ARRANGEMENTS

BACKGROUND OF THE INVENTION

1. Field of the Invention

The present invention relates to container systems for floral arrangements and more particularly to container systems for presenting cut flowers and the like in an attractive manner.

2. Description of the Prior Art

One previously proposed method of presenting cut flowers and the like involves the use of an open cell foam of relatively friable structure which can be easily pierced by the stem of a flower so that the flower stem is supported within the foam which also constitutes a reservoir for water, the foam standing within a shallow tray which constitutes a reservoir for further water and which also serves to carry a mesh-like support which retains the foam in position. Such a foam may be referred to as a florist's foam and one well known type of foam suitable for this purpose is sold under the trade mark "OASIS". The assembly consisting of tray, foam, and mesh can be stood within an outer decorative container, for example of cardboard suitably shaped and decorated to form an attractive package.

One significant disadvantage with the system proposed above is that the trays are only able to hold a restricted volume of water and require frequent topping up. It is not practicable to increase the water holding capacity just by increasing the size of the tray as this, then, results in restrictions in the range of outer container sizes which can be used and also reduces the inherent versatility of the system.

SUMMARY OF THE INVENTION

According to the present invention, there is provided a container system for a floral arrangement, comprising a waterproof container having a base portion which can act as a water reservoir, and a separate insert locatable from above into a lower part of the container, said insert acting to confine from above water within the reservoir, said insert carrying a porous water-retaining material lying within the reservoir, said porous material extending upwardly through the insert so that an upper portion of the material is exposed to receive the stems of cut flowers and the like.

Advantageously the porous material consists of a block of a foam material of a type which is sufficiently friable that it can be pierced by the stems of cut flowers so that the stems are held by the foam material.

Preferably, the block of foam material is anchored within the insert so that the block is held firmly between the insert and the base of the outer container.

Advantageously the insert is configured to be a relatively tight sliding fit with the interior of the container so as to minimise the risk of leakage of water from the reservoir past the edges of the insert. Advantageously the insert is formed with one or more access ports, preferably adjacent the foam block, and through which the reservoir can be filled with water.

In one particularly preferred form of the invention, the container is of box-like form erected from a blank of board material, for example a cardboard material, made watertight by a waterproof liner applied to the interior surface of the container prior to, or during, installation of the insert. The insert may be formed from a waterproof or water-resistant material, for example a semi-rigid plastics sheet material capable of being cut and folded. Preferably, the insert is formed to provide tabs which may be bent to rigidify the sheet and also, possibly, engage the base of the container to support the insert therefrom.

BRIEF DESCRIPTION OF THE DRAWINGS

An embodiment of the invention will now be described, by way of example only, with reference to the accompanying drawings, in which:FIG.

FIG. 1 shows schematically the primary components of a container system in accordance with a preferred embodiment of the invention;

FIG. 2 is a schematic vertical section showing the container system in its assembled state;

DESCRIPTION OF THE PREFERRED EMBODIMENTS

Figure 3:
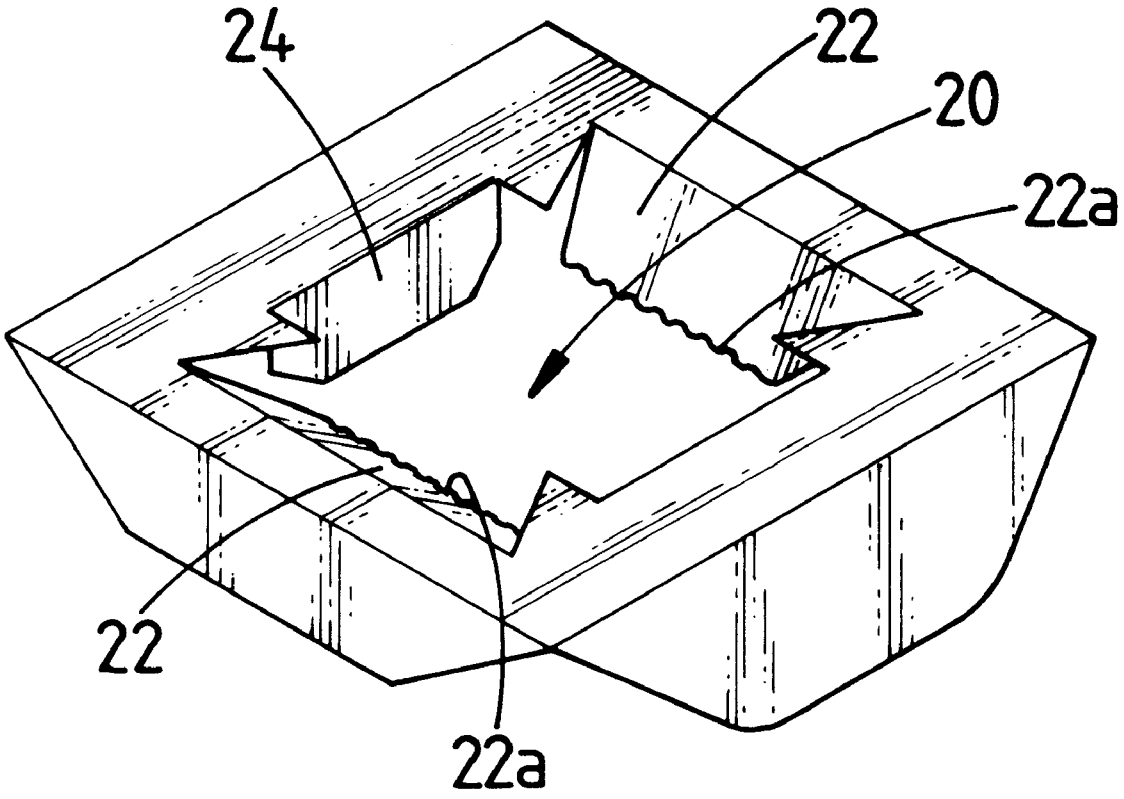
FIG. 3 is a perspective view showing an alternative form of insert for the system shown in FIG. 1.

As shown in the accompanying drawings a container system in accordance with a preferred embodiment of the present invention comprises an outer container 2 preferably of box-like form erected from a blank of suitable material, for example of corrugated or other board. The interior of the box 2 is made watertight using a liner 4 of a thin waterproof plastics sheet, for example of polyethylene or polypropylene which is retained within the box 2 by an insert 6 which carries a foam block 8 for cut flowers. The insert 6 is pushed downwardly into the box 2 from above onto the sheet of plastics film forming the liner 4 so that the liner 4 is moved onto the bottom of the box 2 and held in shape by the insert 6. As shown, the insert 6 is formed from a sheet of waterproof or water-resistant material which can be cut and folded to a required shape. In one preferred form, the insert 6 is fabricated from an extruded plastics sheet material of semi-rigid form comprising opposed outer layers interconnected by a series of spaced parallel webs as manufactured and sold under the trade mark "COREFLUTE". The edges of the insert 6 are formed with two sets of opposed tabs 6*a*, 6*b*. One set of tabs 6*a* is folded upwardly from the plane of the insert 6 and act to rigidify the insert against bending deflection and the other pair of tabs 6*b* is folded downwardly to form legs by which the insert 6 is supported from the bottom of the box 2 and further rigidify the insert 6 against bending deflection. In an alternative form, both sets of tabs 6*a*, 6*b* may be folded upwardly or downwardly.

The central part of the insert 6 is formed with an aperture for receiving the block 8 of florists foam such as that sold under the trade mark "OASIS". The block foam 8 projects to the bottom of the box 2 and extends upwardly through the insert 6 to form above the insert an exposed portion for receiving the stems of cut flowers and the like. The foam block 8 is retained within the insert 6 by means of a support 10, for example consisting of a flexible plastics mesh, which fits within the aperture in the insert 6 and surrounds the upper exposed part of the block 8 while still permitting access through the mesh for the flower stems. Preferably, the block 8 is a relatively tight fit within the aperture in the insert 6 and thereby retains the mesh support 10 within the aperture with a lower edge l0*a* of the mesh support 10 being trapped beneath the edge of the aperture as shown in FIG. 2.

In order to assemble the container system just described, the outer box 2 is first erected from the blank. Plastics film for forming the internal liner 4 is then cut approximately to size. The foam block 8 is pre-saturated with water and is mounted within the insert 6 in which it is held in place by the mesh support 10. The liner 4 is placed over the top of the box 2 and the insert 6 carrying the saturated foam block 8 is moved downwardly into the box 2 thereby pushing the liner 4 into the box. The insert 6 is shaped to be a relatively tight fit within the interior of the box so that frictional pressure between the edges of the insert 6 and the inner surface of the box 2 is sufficient to hold the bottom of the foam block 8 firmly against the bottom of the box 2, with the foam block effectively being wedged between the bottom of the box 2 and the mesh support 10 which encloses the upper part of the foam block 8. The relatively tight fit between the insert 6 and box 2 also acts to resist escape of water from the bottom part of the box 2 beneath the insert 6 whereby the system is less susceptible to spillage. The aperture within the central part of the insert 6 and which receives the upper part of the foam block 8 is also shaped to form one or more access ports 12 (see FIG. 1) outside of the periphery of the block 8 and through which water can be poured into the bottom part of the box 2. When the insert 6 with the foam block 8 has been inserted into position in the lower part of the box 2, water possibly treated with product to increase the life of the cut flowers, is poured into the bottom part of the box 2 through the access ports 12 provided in the insert 6 around the foam block 8. The bottom part of the box 2 then acts as a relatively large capacity reservoir 14 which can contain sufficient water to last for the life of the flowers. As mentioned previously, due to the relatively tight fit between the insert 6 and inner wall of the box 2, the system is not susceptible to spillage of water from the reservoir 14, for example during transportation from the florist to the customer. Likewise, the positioning of the access ports 12 within the central part of the insert 6 adjacent the foam block 8 will minimise the risk of spillage occurring through these ports.

Instead of forming the liner 4 from a plastics sheet, the liner 4 can consist of a thin waterproof plastics bag.

Figure 4:
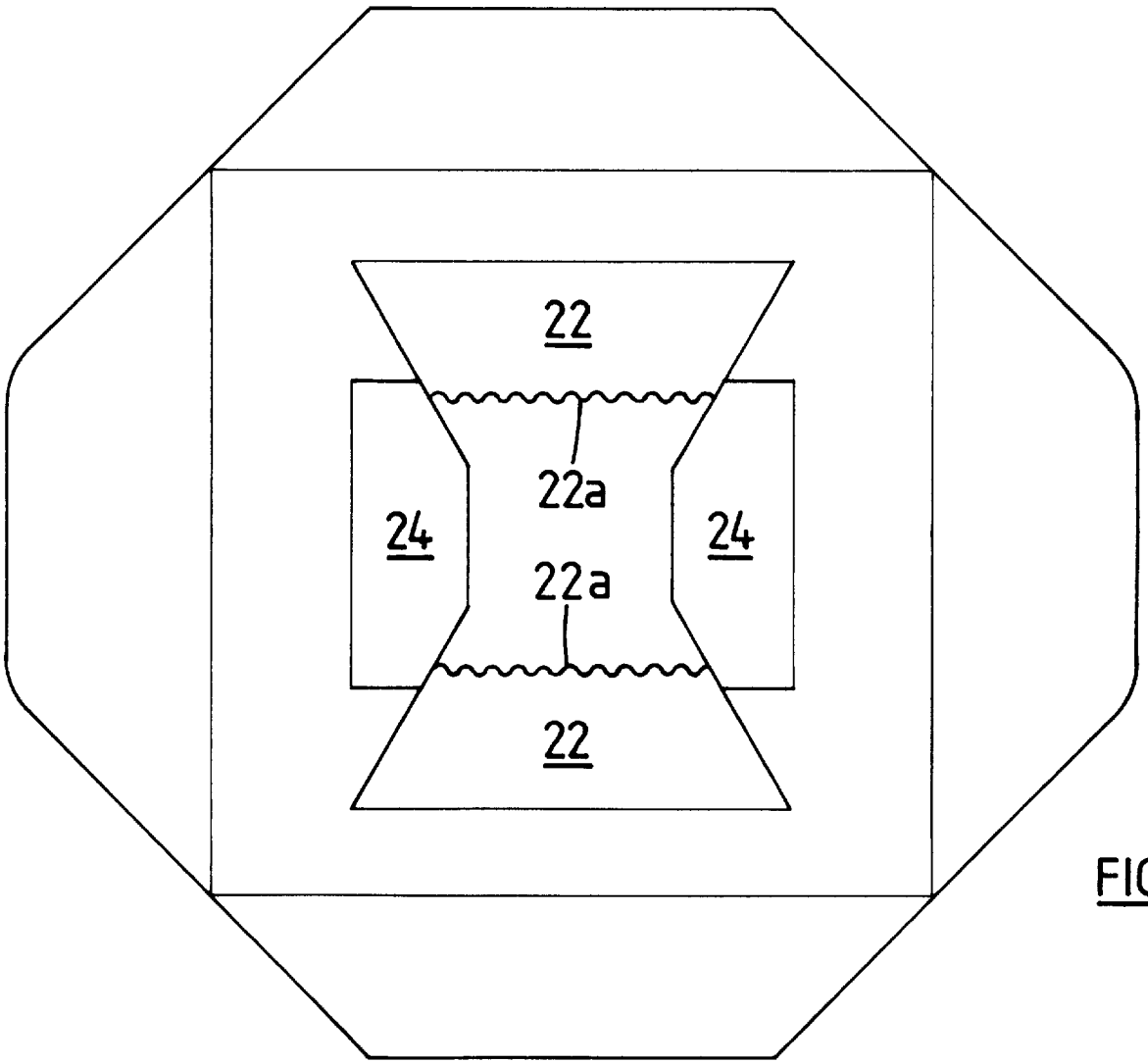
FIG. 4 is a plan view of a blank for forming the insert of FIG. 3.

In an alternative form of insert shown in FIG. 3, the aperture 20 within the insert for receiving the foam block is bounded on two opposed sides by downwardly inclined flaps 22 with serrations 22*a* along their inner edges to bite into the foam block whereby to grip the block and thereby to prevent upwards movement of the block within the insert, thus obviating the need for the mesh support. This type of insert is particularly suitable for use with foam blocks of a structure which renders the block relatively coherent and not readily friable at the edges. However, for blocks of a structure which renders their edges rather more friable, the first form of insert with the mesh support would be preferred. In this alternative form of insert, the downwardly inclined flaps 22 with serrations at their inner edges also act as ducts for feeding water into the reservoir in the bottom part of the box beneath the insert, the serrations 22*a* defining a series of small ports to facilitate passage of the water past the inner edge of each flap 22 The insert shown in FIG. 3 is produced from a blank as shown in FIG. 4 from which it will be seen that in addition to the opposed flaps 22 bounding one pair of opposed sides of the aperture 20, the aperture 20 is bounded at its other pair of opposite sides by flaps 24 which are folded downwardly to lie against the adjacent sides of the block whereby the block is firmly seated and retained within the insert.

Although it is preferred to form the outer container of the system in the form of a box of cardboard or the like which is then made waterproof by an applied lining, as cardboard as boxes can be easily produced in the form of blanks of sheet material which can easily be printed with suitable exterior designs and colours and can readily be stored in blank form, alternatively the outer container could be in the form of a preformed watertight container, for example of a suitable plastics material. The insert 6 may also be preformed in a rigid plastics material.

The embodiment has been described by way of example only and modifications are possible within the scope of the invention.

What is claimed is:

1. A container system for a floral arrangement, comprising:

a waterproof container having a base portion defining a water reservoir; and an insert, said insert acting to confine, from above, water within said reservoir, said insert carrying a porous, water-retaining block of foam lying within said reservoir, said block of foam extending upwardly through said insert so that an upper portion of said block of foam is exposed to receive the stems of cut flowers and the like, said block of a foam being sufficiently friable so that it can be pierced by the stems of cut flowers and the like so that the stems of cut flowers and the like are held in place by said block of foam, said block of foam being anchored within said insert by a support carried by said insert and extending over an upper part of said block of foam so that said block of foam is held firmly between said insert and said base portion of said container.

2. A container system according to claim 1, wherein the support comprises a mesh.

3. A container system for a floral arrangement, comprising a waterproof container having a base portion which can act as a water reservoir and a separate insert locatable from above into a lower part of the container, said insert carrying a block of a porous foam material extending upwardly through the insert so that an upper portion of the material is exposed to receive the stems of cut flowers and the like, said insert being of sheet-like form and having an opening within which said block fits whereby said block substantially fills the opening, said insert together with the block filling the opening therein acting to form an upper closure for the reservoir whereby to substantially prevent spillage of water from the reservoir, the part of said insert defining said opening therein having opposed rows of tooth-like serrations which bite into the block to retain the block to the insert.

4. A container system according to claim 3, wherein the tooth-like serrations also define ducts through which the reservoir can be filled with water.

5. A container system for a floral arrangement, comprising:

a waterproof container having a base portion defining a water reservoir;

a block of a porous foam material; and an insert, said insert having a sheet-like form and having an opening therein for receiving said block such that said block substantially fills said opening, said block extending upwardly through said insert so that an upper portion of said block is exposed to receive the stems of cut flowers and the like, said insert together with said block forming an upper closure for said reservoir to substantially prevent the spillage of water from said reservoir, said opening of said insert having opposing rows of tooth-like serrations which retain said block with said insert.

6. A container system according to claim 5, wherein said tooth-like serrations define ducts through which said reservoir can be filled with water.

* * * * *